United States Patent [19]

Britson

[11] 4,272,576

[45] Jun. 9, 1981

[54] WALL COVERING

[76] Inventor: Stanley N. Britson, White Fox Rd., Webster City, Iowa 50595

[21] Appl. No.: 80,347

[22] Filed: Oct. 1, 1979

[51] Int. Cl.[3] ..... E04D 1/34; B32B 3/06

[52] U.S. Cl. ..... 428/100; 428/99; 428/130; 428/134; 428/137; 428/138; 428/595; 52/545; 52/551; 52/519; 24/201 C

[58] Field of Search ..... 52/276, 530, 531, 544, 52/551, 545, 529, 518, 520; 428/130, 134, 137, 138, 99, 100, 595; 24/201 C

[56] References Cited

U.S. PATENT DOCUMENTS

| | | | |
|---|---|---|---|
| 2,126,676 | 8/1938 | Thomas | 52/520 |
| 3,703,062 | 11/1972 | McKinney | 52/551 X |
| 3,959,856 | 6/1976 | Ausnit | 24/201 C |
| 4,054,012 | 10/1977 | Paradisi et al. | 52/519 X |
| 4,079,562 | 3/1978 | Englert et al. | 52/545 |

FOREIGN PATENT DOCUMENTS

| | | | |
|---|---|---|---|
| 1195066 | 11/1959 | France | 52/544 |

*Primary Examiner*—Marion McCamish
*Assistant Examiner*—Alexander S. Thomas
*Attorney, Agent, or Firm*—Zarley, McKee, Thomte, Voorhees & Sease

[57] ABSTRACT

The wall covering of the present invention comprises an elongated horizontal siding member having at its lower edge a U-shaped female locking flange. A separate horizontal bottom strip is adapted to be connected to the wall adjacent the lower edge of the horizontal siding member. The bottom strip includes a male locking flange sized to frictionally fit within and be retentively held in the female locking flange of the horizontal siding member. The interlocking relationship between the bottom strip and the lower edge of the siding member provides positive securement of the lower edge of the siding member to the wall.

2 Claims, 5 Drawing Figures

WALL COVERING

BACKGROUND OF THE INVENTION

This invention relates to wall coverings and particularly to wall coverings using elongated siding members such as employed in metal siding and plastic siding.

One problem encountered with this type of siding is the manner in which the lowermost siding member is secured to the wall. It is necessary to shim out the bottom edge of the bottom siding member with a piece of lath which is secured to the wall being sided. Furthermore, once the lath has been installed, it is necessary to secure a bottom strip to the lath which engages the bottom edge of the siding member to hold the bottom edge in place.

Several problems have been encountered with the present means for securing the bottom siding member. After the siding has been installed, the house or building upon which it is installed continues to expand and contract and also to settle and move with the passage of time and with changes in the weather. This expansion and contraction and moving causes a slight shifting in the siding members which are secured to the outside of the wall. The result is that the lower edge of the siding member moves upwardly and downwardly irregularly and often becomes detached from the bottom strip which is used to hold the bottom edge of the siding in place. Once the bottom siding member has become detached, there is no simple way to reattach it to the wall without removing and replacing a large portion of the siding.

Another problem encountered with present siding structure is the difficulty encountered in trying to line up the bottom strip with the bottom edge of the siding. Present methods make it difficult to provide a straight horizontal line around the bottom edge of the siding with the siding strips.

SUMMARY OF THE INVENTION

The present invention utilizes a bottom strip which includes an upper vertical portion in facing engagement with the wall and means for securing this upper portion to the wall. Extending downwardly and outwardly from this upper vertical portion is an angled portion of the bottom strip which terminates in a lower end having a male locking flange therein. The male locking flange is sized to frictionally fit within the female locking flange found on the bottom edges of conventional metal and plastic siding. The locking flange of the bottom strip press fits within the locking flange of the siding and retentively holds the siding against movement. Because the bottom strip angles outwardly from the wall, it holds the bottom edge of the siding outwardly and therefore eliminates the need for lath or other shimming devices to shim out the bottom edge of the siding.

The bottom strip of the present invention is spaced outwardly from the wall at its lower end, and therefore if the siding and the bottom strip should become detached due to expansion or contraction of the building, it is a simple matter to manually reach in and reattach the siding to the bottom strip by snapping the two together.

Therefore, a primary object of the present invention is the provision of an improved system for attaching siding to a wall.

A further object of the present invention is the provision of a wall covering having a bottom strip adapted to retentively engage the bottom edge of the siding and hold it against movement.

A further object of the present invention is the provision of a bottom strip which not only retentively attaches to the bottom edge of the siding, but also shims the siding outwardly away from the wall.

A further object of the present invention is the provision of a wall covering having a bottom strip which can be easily reattached to the siding in the event that it becomes detached as the result of expansion or movement of the building.

A further object of the present invention is the provision of a wall covering having a bottom strip which can be readily adjusted vertically to conform with the bottom edge of the siding.

A further object of the present invention is the provision of a wall covering having a bottom strip which engages the bottom edge of the siding in such a manner to minimize movement of the bottom edge of the siding.

A further object of the present invention is the provision of a wall covering having a bottom strip which simplifies the process of applying the siding to the wall.

A further object of the present invention is the provision of a wall covering which is economical to manufacture, durable in use and efficient in operation.

DETAILED DESCRIPTION OF THE INVENTION

Figures 1, 2, 3, 4, 5:
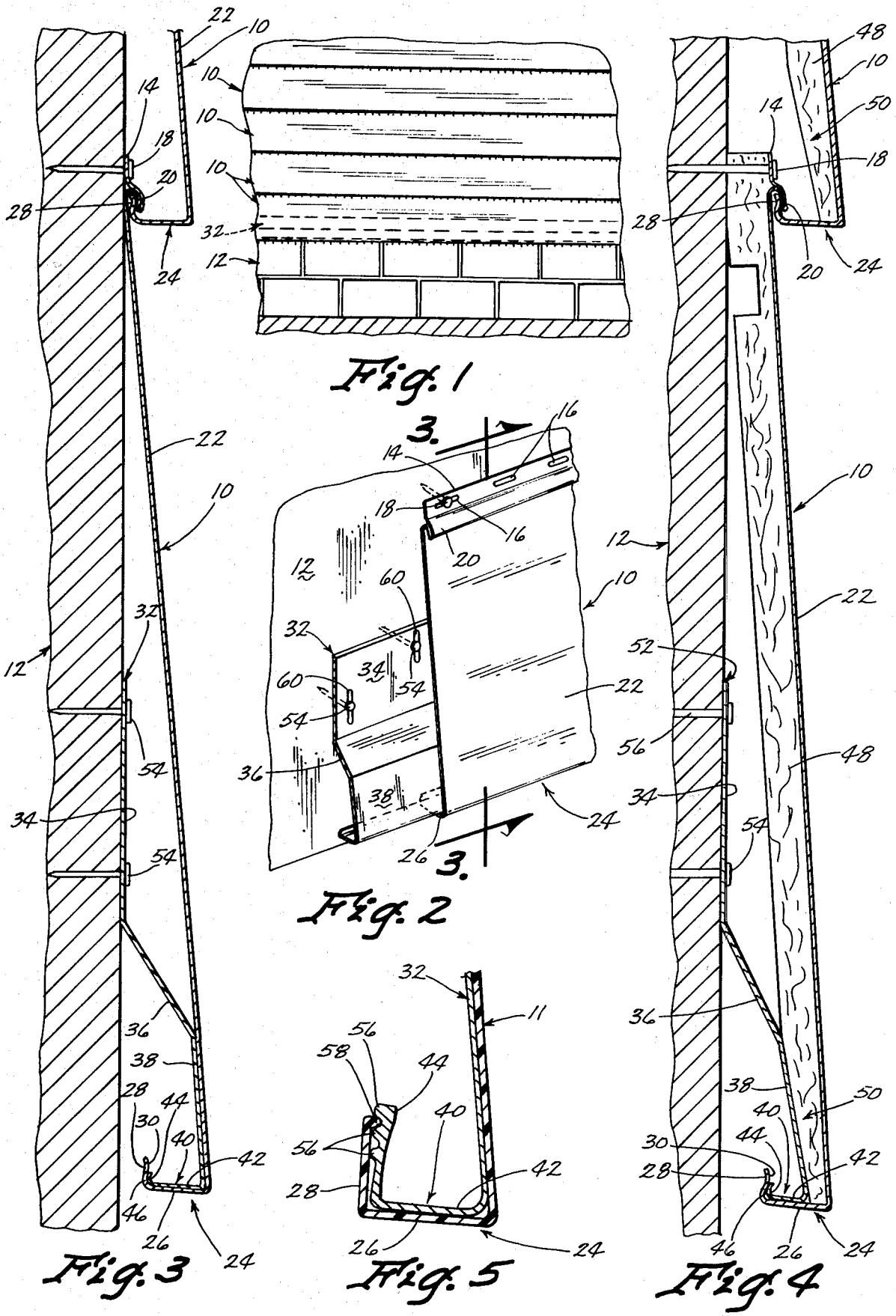
FIG. 1 is a side elevational view of a building wall having siding thereon.
FIG. 2 is a partial perspective view of the bottom siding member and the bottom strip with portions of the siding member broken away to show the bottom strip.
FIG. 3 is an enlarged sectional view taken along line 3—3 of FIG. 2.
FIG. 4 is a view similar to FIG. 3, but showing the present invention in combination with siding having insulative material on the interior surface thereof.
FIG. 5 is a partial sectional view showing the bottom locking flanges of a modified form of the invention.

Referring to FIG. 1, a plurality of siding members 10 are shown mounted in overlapping relationship on a wall 12.

Each siding member 10 has an upper edge 14 having a line of holes 16 extending therealong for securing upper edge 14 to wall 12 by means of nails 18.

Immediately below the line of holes 16 is an elongated upper locking flange 20 which extends outwardly and downwardly in hook like fashion. Siding member 10 then includes a downwardly and outwardly angled surface 22 which terminates in a lower locking flange 24 at its lower end.

Lower locking flange 24 comprises a horizontal portion 26 and an upwardly extending lip portion 28. Horizontal portion 26 and lip portion 28 give locking flange 24 a J-shaped configuration. Lip portion 28 includes a rolled bead 30 which protrudes outwardly from wall 12.

Referring to the upper portion of FIG. 3, the manner in which each overlapping side member 10 is secured to the next lower side member 10 is shown. Lower locking flange 24 of the upper side member protrudes within and retentively engages the upper locking flange 20 of the lower siding member. This is the conventional manner for placing siding members on a wall.

In the placement of the siding members on the wall, conventional practice is to mount the lowermost siding member first. The present invention utilizes for this purpose a bottom strip designated by the numeral 32. Bottom strip 32 includes in cross section an upper vertical portion 34, a first angled surface 36, and a second angled surface 38. At the bottom of second angled surface 38 is a J-shaped locking flange 40 which is sized to matingly retentively fit inside J-shaped flange 24 of siding member 10.

Locking flange 40 comprises a horizontal portion 42 and an upwardly extending lip portion 44. Lip portion 44 extends upwardly and is angled back toward second angled surface 38 so as to create a projection 46 extending toward wall 12. Projection 46 nests within upwardly extending lip portion 28 of locking flange 24 in a position immediately below rolled bead 30. Thus, rolled bead 30 and projection 46 cooperate to retentively hold locking flange 40 within locking flange 24, thereby securing the bottom edge of siding member 10 to wall 12.

As can be seen in FIG. 3, the position of the bottom edge of siding member 10 is held slightly spaced away from wall 12 so that it is possible for a person to reach behind the siding member 10 and snap locking flanges 40, 24 together should they become detached. In presently known devices, there is no space or means for fastening the bottom strip to the siding member should the two become detached after installation.

The angle of second angled portion 38 is approximately equal to the angle of angled surface 22 of siding member 10. Thus, as can be seen in FIG. 3, siding member 10 is in facing engagement with bottom strip 32 along the entire surface of second angled surface 38 and along the entire surface of J-shaped locking flange 40. This provides a positive retentive engagement between bottom strip 32 and siding member 10 so as to minimize the play or slack between the two. Bottom strip 32, by virtue of first angled surface 36, serves as a shim to shim out the bottom edge of siding member 10 so that it will not appear out of place with the other siding members on the wall. Lath strips are presently used to provide the shimming function.

Referring to FIG. 4, a siding member 10 includes an insulation layer 48, on the interior surface thereof. Adjacent the lower edge of siding member 10, insulative layer 48 includes a beveled surface 50. This is conventional construction in siding members having insulative layers on the interior surfaces thereof.

For use with a siding member 10 having insulative material 48 therein, a bottom strip 52 is utilized. Strip 52 is similar in construction to strip 32, with the only differences being in the angles and proportions of first and second angled portions 36, 38. Angled portion 38 is angled so as to be approximately equal to the angle of beveled portion 50 of insulative layer 48. Thus, as seen in FIG. 4, angled portion 38 abuts against and engages beveled portion 50. Bottom strip 52 includes a J-shaped locking flange 40 at its lower end which differs from J-shaped portion 40 shown in FIG. 3 only in the dimensions of the horizontal portion 42. In FIG. 4, the dimension is slightly smaller so that J-shaped portion 40 can nest within the space between beveled portion 50 and lip 28 of siding member 10. Bottom strips 32 and 52 are held in place by nails 54.

Referring to FIG. 5, a modified form of the invention is shown. The modification entails forming a plurality of beads 56 on the upper edge of lip portion 44 for engaging a corresponding bead 58 on the upper edge of lip 28 of a plastic siding member 11. Bead 58 is conventionally formed on such plastic siding members. For use with plastic siding members, it is possible to form bottom strip 32 from plastic also and to form beads 56 as shown in FIG. 5. This permits bead 58 to lock within one of the spaces between beads 56. By providing a plurality of beads 56 with a plurality of corresponding spaces therebetween, it is possible to assure that member 11 and strip 32 are locked together as tightly as possible.

The vertical position of strip 32 may be adjusted by virtue of the elongated vertical slots 60 which retain nails 54. Furthermore, should the expansion or settling of the building to which the siding is attached cause the siding to become detached from bottom strip 32, it is a simple matter to reach behind J-shaped locking flanges 40, 24 and to snap them together manually. Thus, it can be seen that the device accomplishes at least all of its stated objectives.

What is claimed is:

1. A wall covering for attachment to a wall, said covering comprising:

an elongated horizontal siding member having an upper edge and a lower edge, first securing means for attaching said upper edge of said siding member to said wall, a horizontal bottom strip having in cross section a single thickness comprising an upper vertical surface, a first angled surface extending downwardly from said vertical surface and outwardly away from the vertical plane of said vertical surface, a second angled surface extending downwardly and outwardly from said vertical plane at a steeper angle than said first angled surface, and a male locking flange extending inwardly toward said vertical plane from the lower edge of said second angled surface;

second securing means for attaching said upper vertical surface of said strip to said wall;

said elongated siding member having a female locking flange at the lower edge thereof, said female locking flange extending inwardly toward said vertical plane and retentively surrounding and embracing said male locking flange of said bottom strip so as to be held against movement by said bottom strip;

said siding member extending downwardly at an angle which is substantially the same as said steeper angle of said second surface and being in facing engagement with the entire surface of said second angled surface;

said male and female locking flanges being spaced outwardly from said vertical plane sufficiently far to permit manual access between said vertical plane and said male and female locking flanges together;

said male locking flange having in cross section a horizontal portion extending from said lower edge of said second angled surface to an inner edge spaced from said vertical plane, said male locking flange further including a lip portion extending upwardly from said inner edge of said horizontal portion;

said female locking flange having in cross section a horizontal portion and a lip portion surrounding and embracing said horizontal and lip portions of said male locking member;

said lip portion of said female locking flange having a bead portion extending toward said lip portion of said male locking flange for retentively locking said male and female locking flanges together in nested relationship;

said lip portion of said male locking flange having an outward projection extending toward said lip portion of said female locking flange at a point below said bead portion whereby said outward projection and said bead portion engage one another to retentively hold said male and female locking flanges in nested relationship;

said second securing means comprising horizontally spaced apart vertically elongated holes permitting horizontal adjustment of said bottom strip around said wall.

2. A wall covering according to claim 1 wherein said lip portion of said male locking flange includes in cross section a plurality of vertically spaced apart projections extending toward said lip portion of said female locking flanges, said bead portion of said female locking flange protruding into the space between two of said spaced apart projections so as to retentively lock said male and female flanges in nested relationship.

* * * * *